US010565927B2

(12) United States Patent
Suk et al.

(10) Patent No.: US 10,565,927 B2
(45) Date of Patent: Feb. 18, 2020

(54) ELECTROLUMINESCENT DISPLAY AND METHOD OF COMPENSATING FOR ELECTRICAL CHARACTERISTICS OF ELECTROLUMINESCENT DISPLAY

(71) Applicant: LG Display Co., Ltd., Seoul (KR)

(72) Inventors: Jungyoup Suk, Paju-si (KR); Hyungnyuck Cho, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 37 days.

(21) Appl. No.: 15/841,659

(22) Filed: Dec. 14, 2017

(65) Prior Publication Data

US 2018/0174518 A1 Jun. 21, 2018

(30) Foreign Application Priority Data

Dec. 19, 2016 (KR) ..... 10-2016-0173888

(51) Int. Cl.

| | |
|---|---|
| ***G09G 3/30*** | (2006.01) |
| ***G09G 3/3233*** | (2016.01) |
| ***G09G 3/3258*** | (2016.01) |
| ***G09G 3/3291*** | (2016.01) |
| *G09G 3/3266* | (2016.01) |

(52) U.S. Cl.

CPC ..... *G09G 3/3233* (2013.01); *G09G 3/3258* (2013.01); *G09G 3/3291* (2013.01); *G09G 3/3266* (2013.01); *G09G 2300/043* (2013.01)

(58) Field of Classification Search

USPC ..... 345/76–86

See application file for complete search history.

(56) References Cited

U.S. PATENT DOCUMENTS

2006/0092185 A1* 5/2006 Jo ..... G09G 3/3233 345/690
2007/0080905 A1* 4/2007 Takahara ..... G09G 3/3233 345/76
2010/0123699 A1* 5/2010 Leon ..... G09G 3/3233 345/211
2010/0225634 A1* 9/2010 Levey ..... G09G 3/3208 345/212
2011/0273483 A1* 11/2011 Miura ..... G09G 3/3233 345/690
2012/0313923 A1* 12/2012 Minami ..... G09G 3/3233 345/212
2014/0329339 A1* 11/2014 Chaji ..... G01R 31/26 438/10
2017/0132972 A1* 5/2017 Tsuchida ..... G09G 3/3233

* cited by examiner

*Primary Examiner* — Kwin Xie
(74) *Attorney, Agent, or Firm* — Polsinelli PC

(57) ABSTRACT

An electroluminescent display device and a method of compensating for electrical characteristics of the electroluminescent display device are disclosed. The electroluminescent display includes a storage memory storing an average current-voltage expression of a display panel and a current value for each pixel, a parameter calculation unit calculating an offset and a gain for each pixel for causing current characteristics for each pixel based on the current value for each pixel to coincide with average current characteristics based on the average current-voltage expression, and a data correction unit correcting input image data to be written to each pixel based on the offset and the gain for each pixel. The average current-voltage expression and the current value for each pixel are obtained through a camera-based sensing process.

19 Claims, 12 Drawing Sheets

ELECTROLUMINESCENT DISPLAY AND METHOD OF COMPENSATING FOR ELECTRICAL CHARACTERISTICS OF ELECTROLUMINESCENT DISPLAY

CROSS-REFERENCE TO RELATED APPLICATION

This application claims the benefit of Korea Patent Application No. 10-2016-0173888 filed on Dec. 19, 2016, which is incorporated herein by reference in its entirety for all purposes as if fully set forth herein.

BACKGROUND

Field of the Disclosure

The present disclosure relates to a display device, and more particularly, to an electroluminescent display and a method of compensating for electrical characteristics of the electroluminescent display.

Description of the Background

Various types of panel displays have been developed and sold. Among the various types of panel displays, an electroluminescent display can be classified into an inorganic electroluminescent display and an organic electroluminescent display depending on a material of an emission layer. In particular, an active matrix organic light emitting diode (OLED) display includes a plurality of OLEDs capable of emitting light by themselves and has many advantages, such as fast response time, high emission efficiency, high luminance, wide viewing angle, and the like.

An OLED serving as a self-emitting element includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When power (or voltage) is applied to the anode electrode and the cathode electrode, holes passing through the hole transport layer HTL and electrons passing through the electron transport layer ETL move to the emission layer EML and form excitons. As a result, the emission layer EML generates visible light.

An OLED display includes a plurality of pixels, each including an OLED and a driving thin film transistor (TFT) that adjusts a luminance of an image implemented on the pixels based on a grayscale of image data. The driving TFT controls a driving current flowing into the OLED depending on a voltage (hereinafter, referred to as "a gate-to-source voltage") between a gate electrode and a source electrode of the driving TFT. An amount of light emitted by the OLED is determined depending on the driving current of the OLED, and the luminance of the image is determined depending on the amount of light emitted by the OLED.

Electrical characteristics of the pixel, such as a threshold voltage and electron mobility of the driving TFT and a threshold voltage of the OLED, may be factors determining an amount of driving current Ids of the driving TFT. Therefore, all the pixels are supposed to have the same electrical characteristics. However, a variation in the electrical characteristics between the pixels may be generated by various causes such as manufacturing process characteristics and time-varying characteristics. The variation in the electrical characteristics between the pixels may lead to a luminance variation. As a result, it is difficult to implement desired images or meet image quality requirements.

In order to compensate for the luminance variation between the pixels, there are so-called external compensation techniques for sensing electrical characteristics of the pixels and correcting (or compensating for) an input image based on the sensing result. In order to compensate for the luminance variation, a current change by an amount of $\Delta y$ has to be ensured when the data voltage applied to the pixel is changed by an amount of "$\Delta x$". Thus, the external compensation technique is to implement the same (or effectively the same) brightness by calculating "$\Delta x$" for each pixel and applying the same pixel current to the OLED. Namely, the external compensation technique may be implemented to adjust the gray levels so that the pixels have the same or effectively the same brightness.

The external compensation technique may include a compensation algorithm that performs a compensation operation so that a current (I)-voltage (V) curve of a pixel to be compensated coincides with an average I-V curve. The average I-V curve may be obtained through a plurality of sensing operations. Digital sensing data for N gray levels is necessary to obtain the average I-V curve, where N is a positive integer equal to or greater than 2. The digital sensing data for the N gray levels is obtained through a sensing time corresponding to N frame periods. As a value of N increases and a resolution of a display panel increases, the sensing time increases. An increase in the sensing time leads to an increase in a tact time, reducing the competitiveness of the product.

In order to implement the external compensation technique, a sensing unit for sensing electrical characteristics of pixels and an analog-to-digital converter (ADC) for converting analog sensing data obtained in the sensing unit into digital sensing data are necessary. The sensing unit and the ADC may be embedded in a driver integrated circuit (IC). In this instance, a chip size and the manufacturing cost of the driver IC increase.

In order to implement the external compensation technique, the electrical characteristics of the pixels have to be sensed through a sensing drive. The sensing dive is performed separately from a display drive of writing data of an input image to the pixels to reproduce the image. Because a gate driver has to generate a gate signal required for both the sensing drive and the display drive, circuit configuration of the gate driver can be complicated.

SUMMARY

The present disclosure provide an electroluminescent display and a method of compensating for electrical characteristics of the electroluminescent display capable of reducing a sensing time required for an initial compensation and simplifying circuit configuration of each of a driver integrated circuit (IC) and a gate driver.

In one aspect, there is provided an electroluminescent display including a storage memory configured to store an average current-voltage expression of a display panel and a current value for each pixel; a parameter calculation unit configured to calculate an offset and a gain for each pixel for causing current characteristics for each pixel based on the current value for each pixel to coincide with average current characteristics based on the average current-voltage expression; and a data correction unit configured to correct input image data to be written to each pixel based on the offset and the gain for each pixel, wherein the average current-voltage expression and the current value for each pixel are obtained through camera-based sensing.

The average current-voltage expression is obtained by applying a least square method to a result of the camera-based sensing for all the pixels at each of a plurality of gray levels.

The storage memory stores the current value for each pixel with respect to at least two gray points.

The parameter calculation unit calculates a parameter necessary for a current-voltage expression for each pixel based on a current value and a gray value measured at the at least two gray points, and calculates the offset and the gain for each pixel for causing the current-voltage expression for each pixel to coincide with the average current-voltage expression.

The data correction unit multiplies the input image data by the gain and adds the offset to the input image data.

The average current-voltage expression and the current value for each pixel indicate initial characteristic values before a driving thin film transistor (TFT) included in each pixel is deteriorated.

Each pixel includes a driving TFT including a gate electrode connected to a first node, a drain electrode connected to an input terminal of a high potential driving power, and a source electrode connected to a second node; a first switching TFT connected to the first node and a data line supplied with a data voltage based on the input image data and switched on and off in response to a first gate signal; a second switching TFT connected to the second node and a reference line supplied with a reference voltage and switched on and off in response to a second gate signal; a storage capacitor connected to the first node and the second node; and an organic light emitting diode connected to the second node and an input terminal of a low potential driving power.

Each pixel includes a driving TFT including a gate electrode connected to a first node, a drain electrode connected to an input terminal of a high potential driving power, and a source electrode connected to a second node; a first switching TFT connected to the first node and a data line supplied with a data voltage based on the input image data and switched on and off in response to a first gate signal; a second switching TFT connected to the second node and a ground power supply and switched on and off in response to a second gate signal; a storage capacitor connected to the first node and the second node; and an organic light emitting diode connected to the second node and an input terminal of a low potential driving power.

In a compensation period in which a mobility of the driving TFT is compensated, a potential of the first node is fixed to the data voltage, and a potential of the second node varies depending on the mobility of the driving TFT.

In the compensation period, the potential of the second node rises in proportion to the mobility of the driving TFT.

The electroluminescent display further includes a gate driver configured to generate the first gate signal and the second gate signal. The first gate signal is input at an OFF-level in an initialization period before a compensation period, at an ON-level from a programming period between the initialization period and the compensation period to the compensation period, and at an OFF-level in an emission period following the compensation period. The second gate signal is input at an ON-level from the initialization period to the programming period and at an OFF-level from the compensation period to the emission period.

The electroluminescent display further includes a data driver configured to supply the reference voltage to the reference line in the initialization period and the programming period and supply the data voltage to the data line in the programming period and the compensation period.

The reference voltage is applied to the second node through the second switching TFT during the initialization period and the programming period. The data voltage is applied to the first node through the first switching TFT during the programming period and the compensation period.

In another aspect, there is provided a method of compensating for electrical characteristics of an electroluminescent display including storing an average current-voltage expression of a display panel and a current value for each pixel in a storage memory; calculating an offset and a gain for each pixel for causing current characteristics for each pixel based on the current value for each pixel to coincide with average current characteristics based on the average current-voltage expression; and correcting input image data to be written to each pixel based on the offset and the gain for each pixel, wherein the average current-voltage expression and the current value for each pixel are obtained through camera-based sensing.

BRIEF DESCRIPTION

The accompanying drawings, which are included to provide a further understanding of the present disclosure and are incorporated in and constitute a part of this disclosure, illustrate aspects of the disclosure and together with the description serve to explain the principles of the disclosure.

Figure 3:
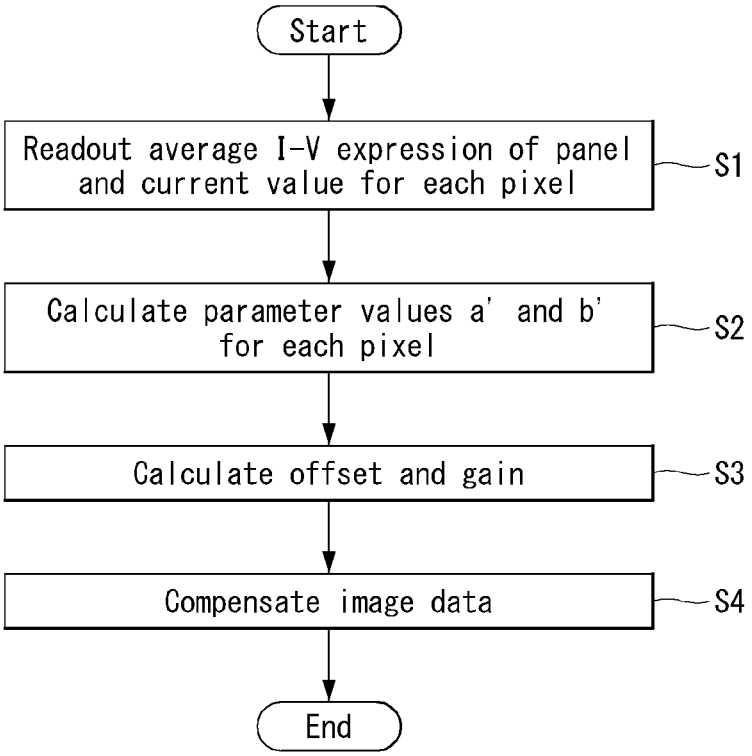
FIG. 3 is a flow chart illustrating an initial compensation method according to an exemplary aspect of the disclosure.
Figure 4:
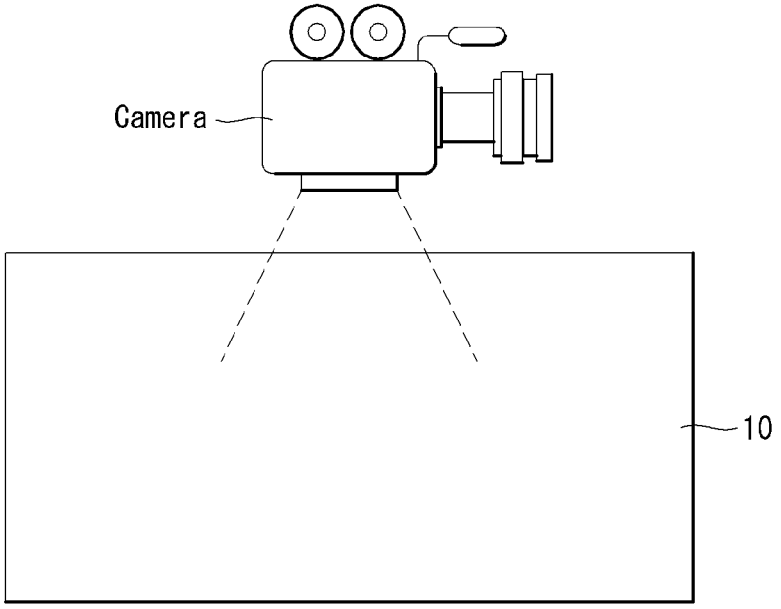
Figure 5A:
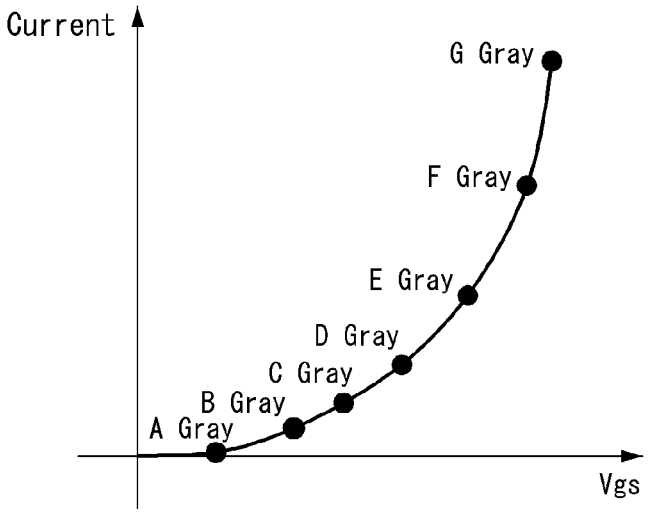
Figure 5B:
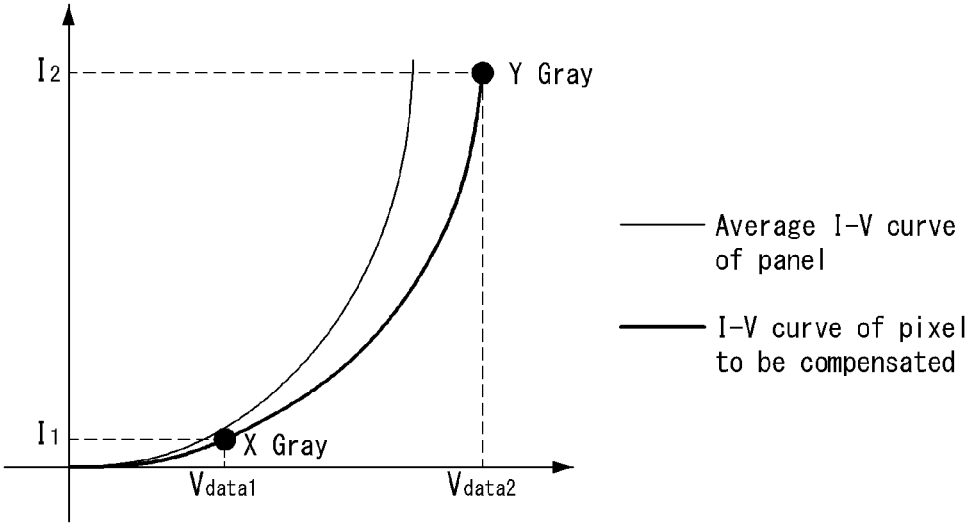
Figure 5C:
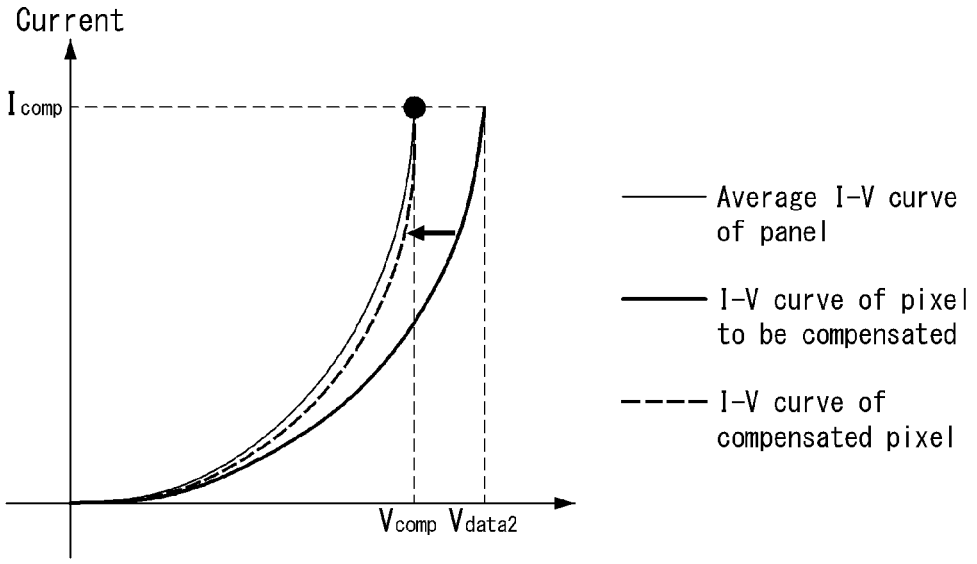
Figure 6:
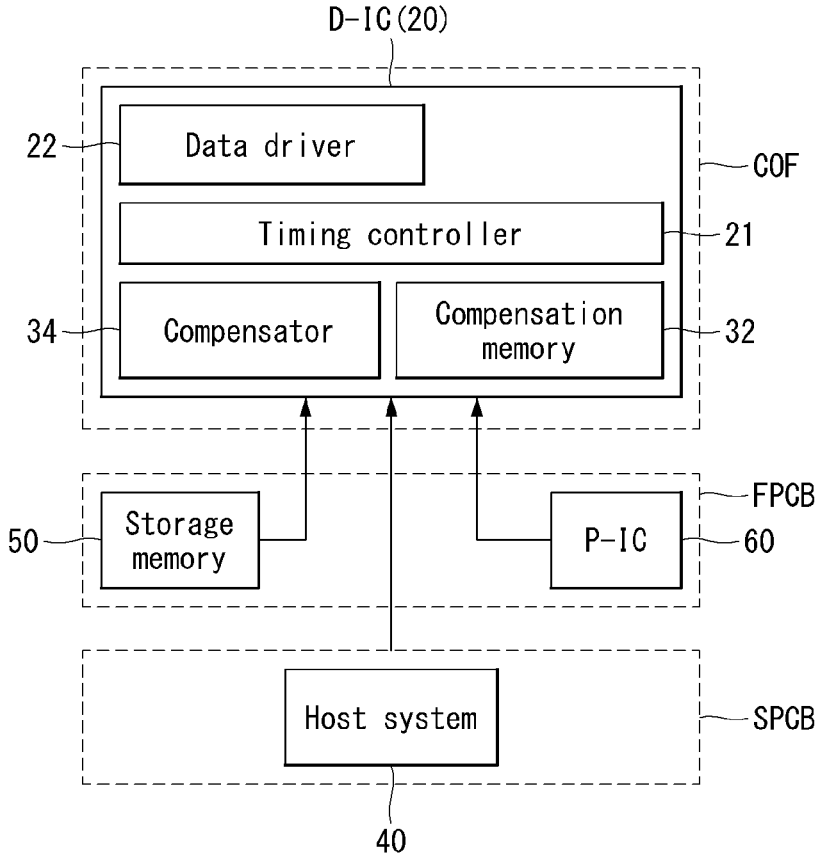
Figure 7:
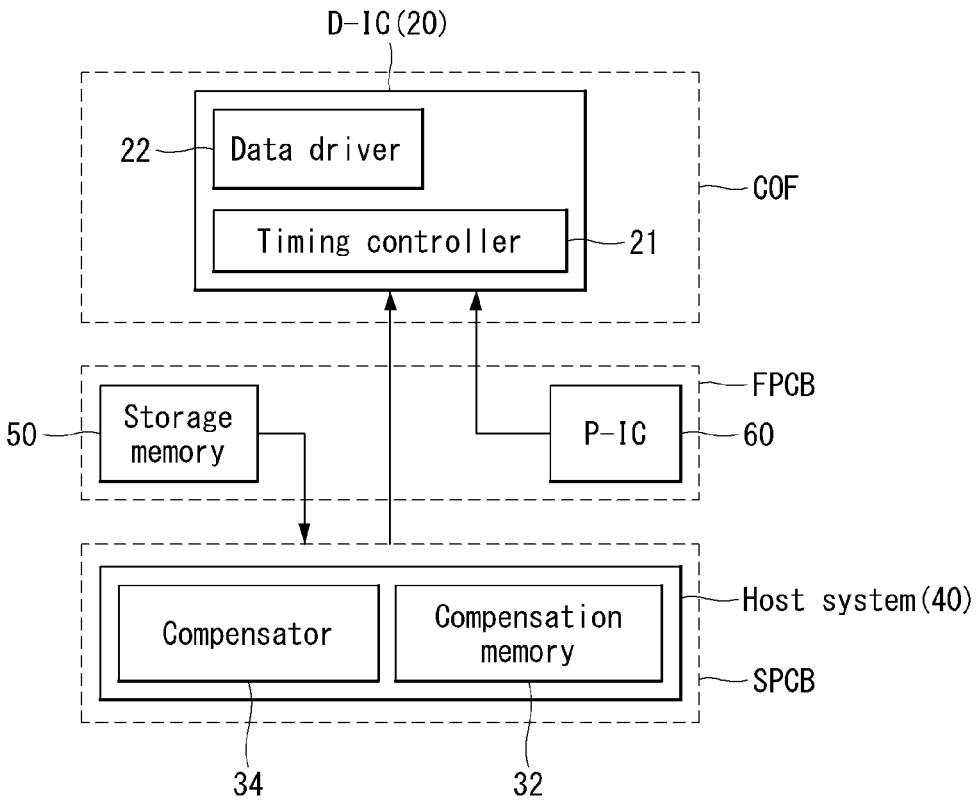
Figure 8:
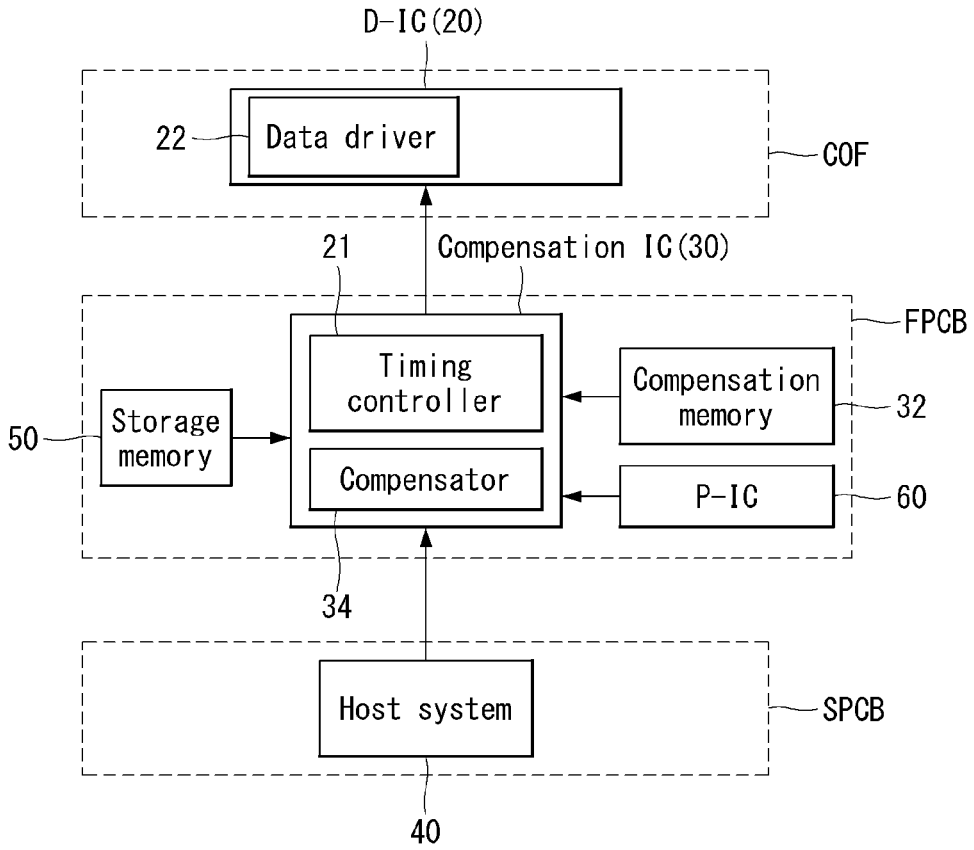
Figure 9:
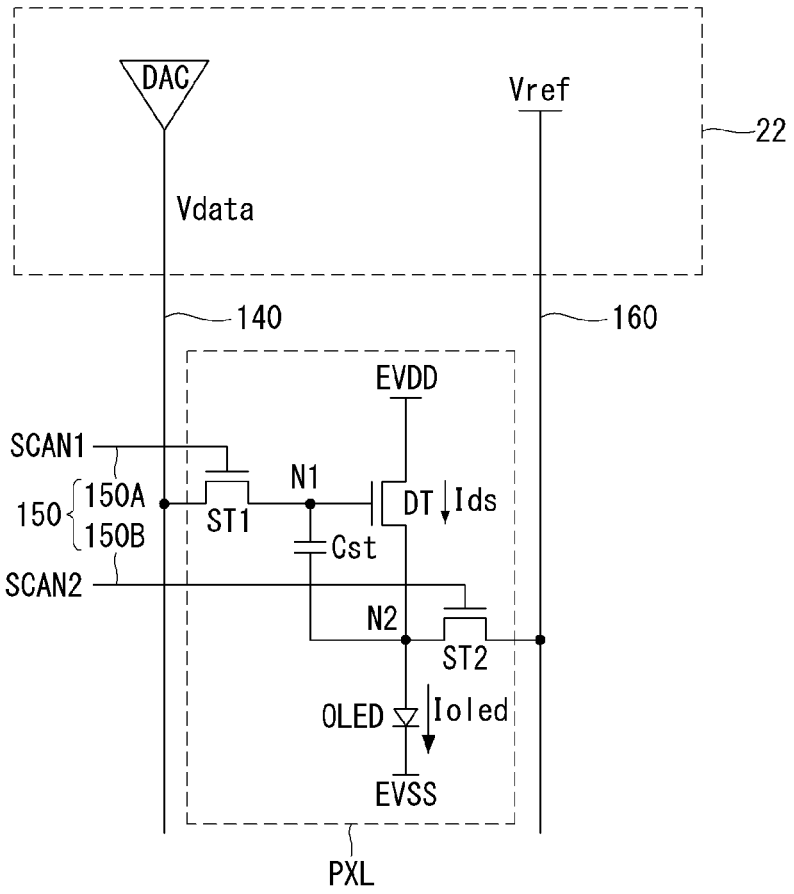
Figure 10:
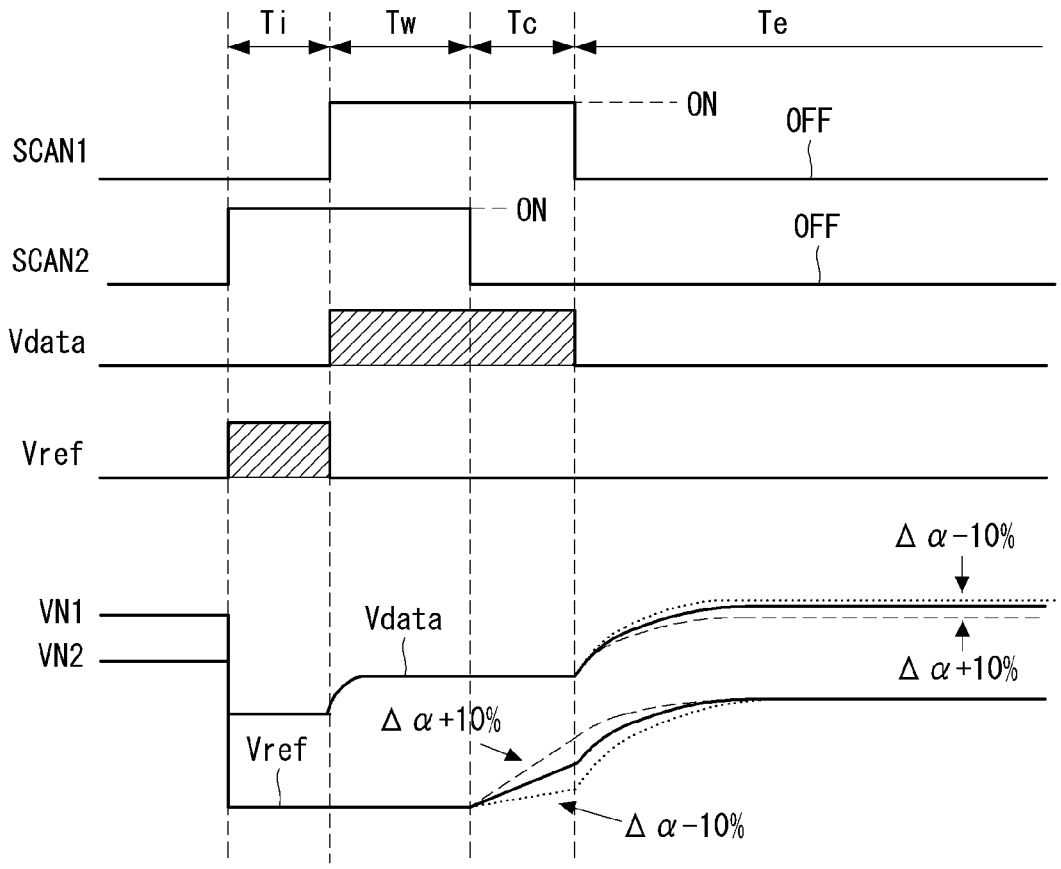
Figure 11:
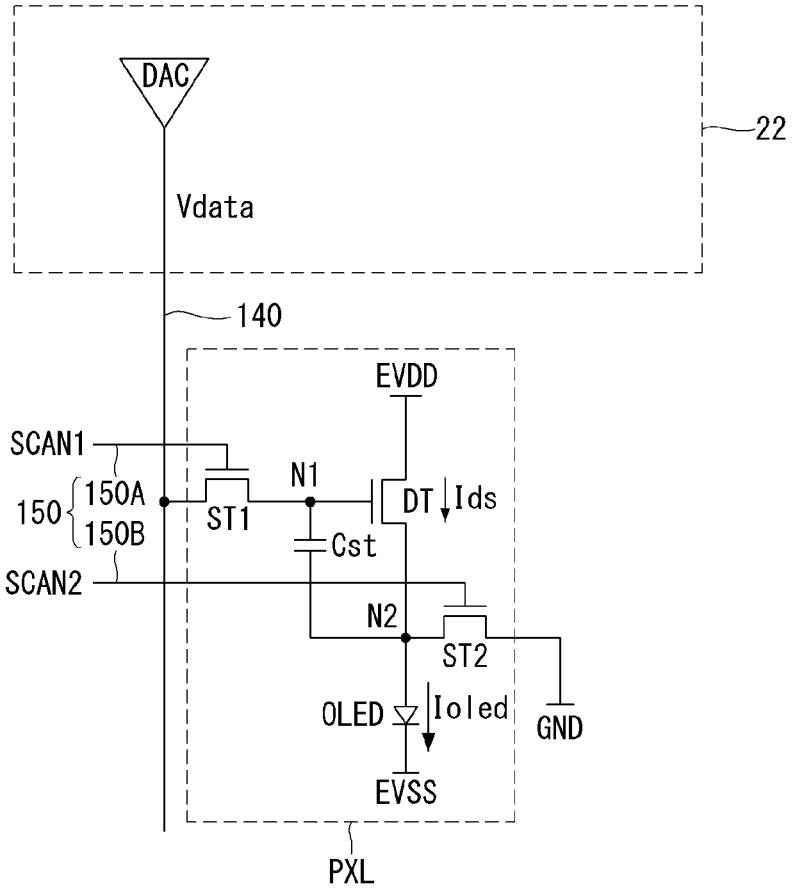

FIG. 4 schematically illustrates a method of obtaining sensing data based on a camera;

FIG. 5A illustrates an average I-V curve of a display panel for an initial compensation method of FIG. 3;

FIG. 5B illustrates an average I-V curve of a display panel and an I-V curve of a pixel to be compensated in an initial compensation method of FIG. 3;

FIG. 5C illustrates an average I-V curve of a display panel, an I-V curve of a pixel to be compensated, and an I-V curve of a compensated pixel in an initial compensation method of FIG. 3;

FIGS. 6 to 8 illustrate various examples of a compensation module;

FIG. 9 illustrates configuration of a pixel according to an exemplary aspect;

FIG. 10 is a timing diagram illustrating compensation for a change in mobility of a driving thin film transistor of a pixel shown in FIG. 9; and FIG. 11 illustrates another configuration of a pixel according to an exemplary aspect of the disclosure.

DETAILED DESCRIPTION

Reference will now be made in detail to aspects of the present disclosure, examples of which are illustrated in the accompanying drawings. However, the present disclosure is not limited to aspects disclosed below, and may be implemented in various forms. These aspects are provided so that the present disclosure will be described more completely, and will fully convey the scope of the present disclosure to those skilled in the art to which the present disclosure pertains. Particular features of the present disclosure can be defined by the scope of the claims.

Shapes, sizes, ratios, angles, number, and the like illustrated in the drawings for describing aspects of the present disclosure are merely exemplary, and the present disclosure is not limited thereto unless specified as such. Like reference numerals designate like elements throughout. In the following description, when a detailed description of certain functions or configurations related to this document that may unnecessarily cloud the gist of the disclosure have been omitted.

In the present disclosure, when the terms "include", "have", "comprised of", etc. are used, other components may be added unless "~only" is used. A singular expression can include a plural expression as long as it does not have an apparently different meaning in context.

In the explanation of components, even if there is no separate description, it is interpreted as including margins of error or an error range.

In the description of positional relationships, when a structure is described as being positioned "on or above", "under or below", "next to" another structure, this description should be construed as including a case in which the structures directly contact each other as well as a case in which a third structure is disposed therebetween.

The terms "first", "second", etc. may be used to describe various components, but the components are not limited by such terms. The terms are used only for the purpose of distinguishing one component from other components. For example, a first component may be designated as a second component, and vice versa, without departing from the scope of the present disclosure.

The features of various aspects of the present disclosure can be partially combined or entirely combined with each other, and can be technically interlocking-driven in various ways. The aspects can be independently implemented, or can be implemented in conjunction with each other.

Various aspects of the present disclosure will be described in detail below with reference to the accompanying drawings. In the following aspects, an electroluminescent display will be described focusing on an organic light emitting diode (OLED) display including an organic light emitting material. However, it should be noted that aspects of the present disclosure are not limited to the OLED display, and may be applied to an inorganic light emitting display including an inorganic light emitting material.

Figure 1:
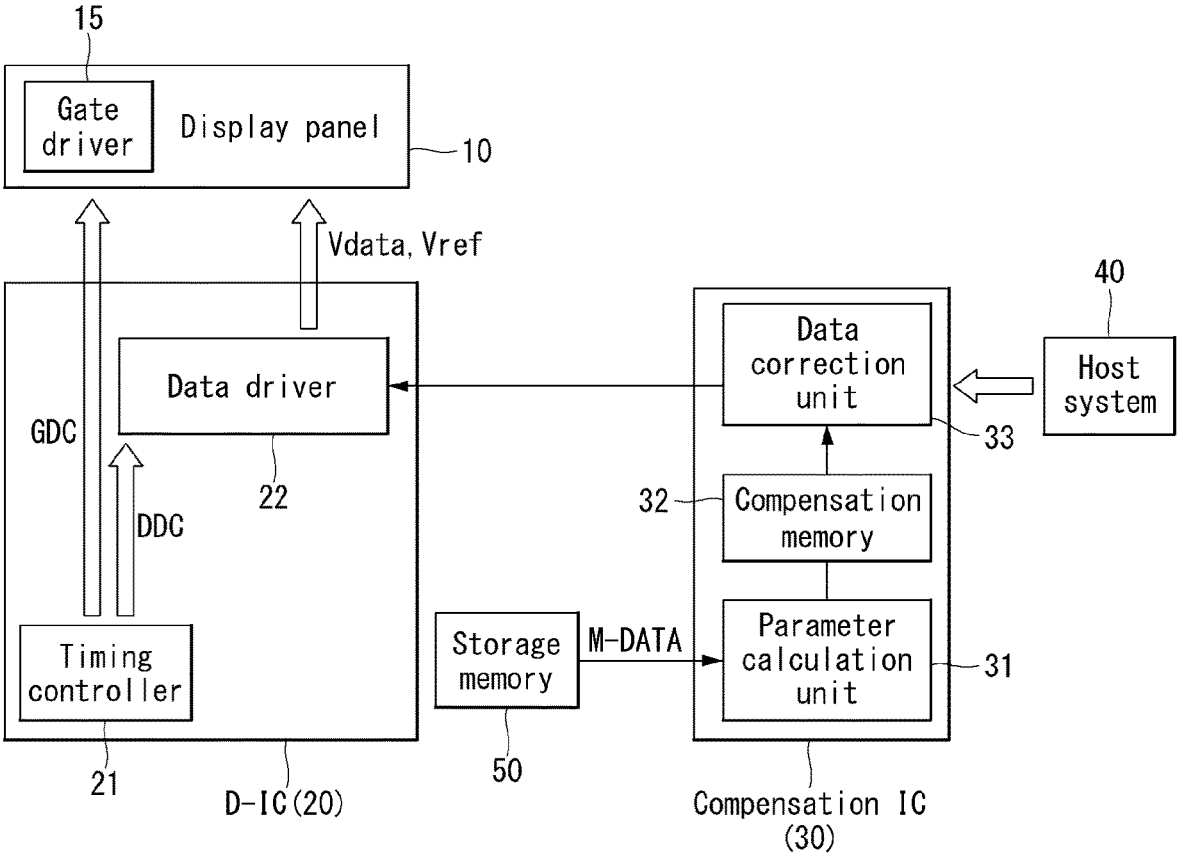
FIG. 1 is a block diagram of an electroluminescent display according to an exemplary aspect of the present disclosure.
Figure 2:
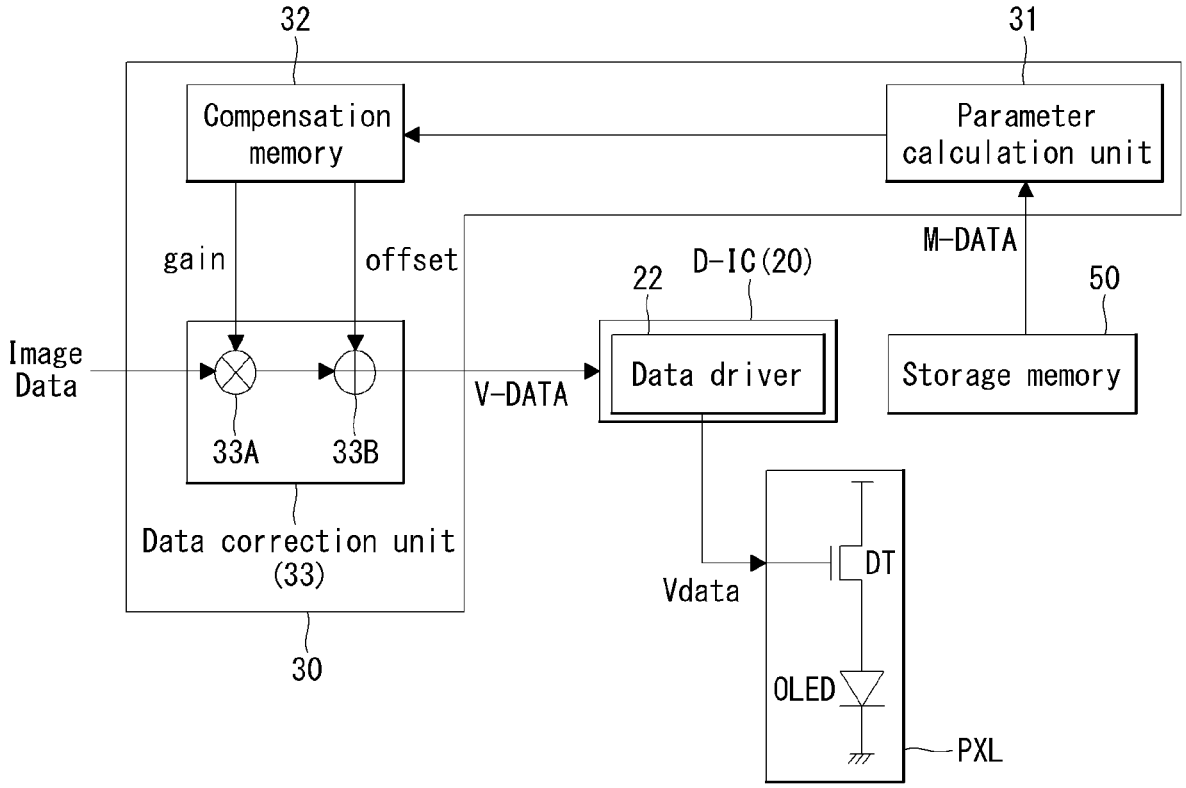
FIG. 2 is a block diagram of an initial compensation circuit according to an exemplary aspect of the disclosure.

FIG. 1 is a block diagram of an electroluminescent display according to an exemplary aspect of the disclosure. FIG. 2 is a block diagram of an initial compensation circuit according to an exemplary aspect of the disclosure. FIG. 3 is a flow chart illustrating an initial compensation method according to an exemplary aspect of the disclosure. FIG. 4 schematically illustrates a method of obtaining sensing data based on a camera. FIG. 5A illustrates an average I-V curve of a display panel for an initial compensation method of FIG. 3. FIG. 5B illustrates an average I-V curve of a display panel and an I-V curve of a pixel to be compensated in an initial compensation method of FIG. 3. FIG. 5C illustrates an average I-V curve of a display panel, an I-V curve of a pixel to be compensated, and an I-V curve of a compensated pixel in an initial compensation method of FIG. 3.

Referring to FIGS. 1 and 2, an electroluminescent display according to an exemplary aspect of the disclosure may include a display panel 10, a driver integrated circuit (IC) (or referred to as "D-IC") 20, a compensation IC 30, a host system 40, and a storage memory 50.

The display panel 10 includes a plurality of pixels PXL and a plurality of signal lines. The plurality of signal lines may further include a plurality of data lines for supplying data signals (e.g., an analog data voltage Vdata) to the pixels PXL, a plurality of gate lines for supplying a gate signal to the pixels PXL, and a plurality of reference lines for supplying a reference voltage Vref to the pixels PXL.

The gate signal may include a plurality of gate signals including a first gate signal (SCAN1 shown in FIG. 9) and a second gate signal (SCAN2 shown in FIG. 9). In this instance, each gate line (150 shown in FIG. 9) may include a first gate line (150A shown in FIG. 9) for supplying the first gate signal SCAN1 and a second gate line (150B shown in FIG. 9) for supplying the second gate signal SCAN2.

The pixels PXL of the display panel 10 are arranged in a matrix to form a pixel array. Each pixel PXL may be connected to one of the data lines, at least one of the gate lines, and one of the reference lines. Each pixel PXL is configured to receive a high potential driving power EVDD and a low potential driving power EVSS from a power generator. To this end, the power generator may supply the high potential driving power EVDD to the pixel PXL through a high potential driving power line or a pad and may supply the low potential driving power EVSS to the pixel PXL through a low potential driving power line or a pad.

A gate driver 15 may generate the first gate signal SCAN1 and supply the first gate signal SCAN1 to the first gate line 150A. Further, the gate driver 15 may generate the second gate signal SCAN2 and supply the second gate signal SCAN2 to the second gate line 150B. As shown in FIG. 10, the first gate signal SCAN1 is a signal synchronized with an application timing of the analog data voltage Vdata, and the second gate signal SCAN2 is a signal synchronized with an application timing of the reference voltage Vref.

The gate driver 15 may be directly formed on a lower substrate of the display panel 10 in a gate-driver in panel (GIP) manner. The gate driver 15 may be formed in a non-display area (i.e., a bezel area) outside the pixel array of the display panel 10 through the same thin film transistor (TFT) forming process as the pixel array.

The driver IC 20 is connected to the data lines and the reference lines of the display panel 10. The driver IC 20 may include a timing controller 21 and a data driver 22.

The timing controller 21 may generate a gate timing control signal GDC for controlling operation timing of the gate driver 15 and a data timing control signal DDC for controlling operation timing of the data driver 22 based on timing signals, for example, a vertical sync signal Vsync, a horizontal sync signal Hsync, a dot clock signal DCLK, and a data enable signal DE received from the host system 40.

The data timing control signal DDC may include a source start pulse, a source sampling clock, and a source output enable signal, and the like, but is not limited thereto. The source start pulse controls start timing of data sampling of the data driver 22. The source sampling clock is a clock signal that controls sampling timing of data based on a rising edge or a falling edge thereof. The source output enable signal controls output timing of the data driver 22.

The gate timing control signal GDC may include a gate start pulse, a gate shift clock, and the like, but is not limited thereto. The gate start pulse is applied to a stage of the gate driver 15 for generating a first output and activates an operation of the stage. The gate shift clock is a clock signal that is commonly input to stages and shifts the gate start pulse.

The timing controller 21 may control an operation of compensation IC 30 according to a predetermined control sequence in a compensation mode for initial compensation and a display mode for a display drive.

In the compensation mode, the compensation IC 30 calculates an offset and a gain for each pixel PXL, in order to compensate for an initial variation in electrical characteristics of the pixels PXL (for example, an initial variation in a threshold voltage of a driving TFT, an initial variation in mobility of the driving TFT, and an initial variation in an operating point of an OLED) depending on process characteristics. The compensation IC 30 then corrects input image data to be written to each pixel PXL based on the calculated offset and gain for each pixel PXL. The compensation mode is performed based on a result of camera-based sensing stored in the storage memory 50.

In the display mode, the compensation IC 30 converts image data V-DATA corrected in the compensation mode into a display data voltage Vdata and applies the display data voltage Vdata to the pixels PXL. In the display mode, change in the mobility of the driving TFT is compensated in real time.

The compensation mode and the display mode may be performed successively. For example, the display mode may be performed immediately after the compensation mode is performed. Further, the compensation mode may be integrated into the display mode and may be performed immediately before the display mode.

The data driver 22 may include a digital-to-analog converter (DAC) converting a digital signal into an analog signal and an output buffer (not shown). The DAC generates the data voltage Vdata, and the output buffer stabilizes and outputs the data voltage Vdata received from the DAC.

In the display mode, the data driver 22 converts the corrected image data V-DATA into an analog gamma voltage using the DAC and supplies a conversion result as the data voltage Vdata to the data lines. In the display mode, the data driver 22 generates the reference voltage Vref using the DAC and supplies the reference voltage Vref to the reference lines. The data voltage Vdata supplied to the data lines in the display mode is applied to the pixels PXL in synchronization with turn-on timing of the first gate signal. The reference voltage Vref supplied to the reference lines in the display mode is applied to the pixels PXL in synchronization with turn-on timing of the second gate signal. A gate-to-source voltage of a driving TFT provided for each pixel PXL is programmed by the data voltage Vdata and the reference voltage Vref. A driving current flowing in the driving TFT is determined depending on the gate-to-source voltage of the driving TFT.

An initial variation in electrical characteristics between the pixels PXL is compensated in the compensation mode performed based on the result of the camera-based sensing, and change in the mobility of the driving TFT included in each pixel PXL is compensated in the display mode in real time. Therefore, aspects of the disclosure do not require a separate sensing mode and a sensing circuit for implementing the sensing mode. In order to implement the sensing mode, a sensing unit for sensing electrical characteristics of pixels and an analog-to-digital converter (ADC) for converting analog sensing data obtained in the sensing unit into digital sensing data were necessary. The sensing unit and the ADC were generally embedded in a driver IC. However, because aspects of the disclosure do not need to embed the sensing unit and the ADC in the driver IC 20, they can simplify circuit configuration of the driver IC 20 and reduce a chip size and the manufacturing cost of the driver IC 20.

In addition, because aspects of the disclosure do not require the separate sensing mode, they can simplify circuit configuration of the gate driver 15. In general, because the gate driver has to additionally generate a gate signal required in the sensing mode in order to implement the sensing mode, the circuit configuration of the gate driver is complicated. On the other hand, because aspects of the disclosure do not need to implement the sensing mode, they do not need to modulate the gate start pulse and the gate shift clock applied to the gate driver 15 for use in the sensing mode. As a result, aspects of the disclosure can simplify the configuration and the overall operation of the gate driver 15.

The storage memory 50 stores camera sensing data M-DATA obtained through the camera-based sensing. The camera sensing data M-DATA may include an average current (I)-voltage voltage (V) expression of the display panel 10 and a current value for each pixel. The average I-V expression of the display panel 10 and the current value for each pixel indicate initial characteristic values before the driving TFT included in each pixel PXL is deteriorated over time.

As shown in FIG. 4, because the camera-based sensing is performed through the entire surface photographing of the display panel 10, there is an advantage that time required for the sensing can be reduced. The average I-V expression may be obtained by applying a least square method to a result of camera-based sensing for all the pixels PXL at each of a plurality of gray levels. The current value for each pixel may be measured (or sensed) with respect to at least two gray points so that parameter calculation is possible. The storage memory 50 may be implemented as a flash memory. However, aspects of the disclosure are not limited thereto.

The compensation IC 30 calculates an offset and a gain for each pixel based on the camera sensing data M-DATA read from the storage memory 50, corrects digital image data to be input to the pixels PXL based on the calculated offset and gain, and supplies corrected digital image data V-DATA to the driver IC 20. To this end, a compensator 34 may include a parameter calculation unit 31 and a data correction unit 33.

The parameter calculation unit 31 may include a compensation algorithm that performs a compensation operation so that a current (I)-voltage (V) expression of each pixel to be compensated coincides with the average I-V expression of the display panel 10. More specifically, as shown in FIGS. 3 and 5A, the parameter calculation unit 31 may readout the following Equation 1 corresponding to an average I-V curve of a plurality of gray levels (for example, a total of seven gray levels A to G) from the storage memory 50 in step S1.

$$I=a(V\text{data}-b)^c \quad \text{[Equation 1]}$$

where "a" is electron mobility of the driving TFT, "b" is a threshold voltage of the driving TFT, and "c" is a physical property value of the driving TFT.

In the above Equation 1, "a" and "b" are values that may vary from pixel to pixel, and "c" is a fixed value.

As shown in FIGS. 3 and 5B, the parameter calculation unit 31 calculates parameter values a' and b' necessary for an I-V expression of a corresponding pixel PXL based on current values I1 and I2 and gray values (gray levels X and Y) (i.e., data voltage values Vdata1 and Vdata2 of digital level) measured with the camera at two gray points in step S2.

$$I1=a'(V\text{data}1-b')^c$$

$$I2=a'(V\text{data}2-b')^c \quad \text{[Equation 2]}$$

The parameter calculation unit 31 may calculate the parameter values a' and b' of the corresponding pixel PXL using a quadratic equation in the above Equation 2. In FIG.

5B, an I-V curve of a pixel PXL to be compensated graphically represents the I-V expression of the corresponding pixel PXL.

As shown in FIGS. 3 and 5C, the parameter calculation unit 31 may calculate an offset and a gain for causing the I-V expression of the corresponding pixel PXL to coincide with the average I-V expression in step S3. An offset and a gain of a compensated pixel are expressed by Equation 3.

$$Vcomp = \left(\frac{a}{a'}\right)^{\frac{1}{c}} \times Vdata + \left\{b' - b\left(\frac{a}{a'}\right)^{\frac{1}{c}}\right\} \quad \text{[Equation 3]}$$

where "Vcomp" is a compensation voltage of digital level.

The compensation memory 32 stores the offset and the gain of each pixel PXL calculated by the parameter calculation unit 31. The compensation memory 32 may be a random access memory (RAM), for example, a double data rate synchronous dynamic RAM (DDR SDRAM), but is not limited thereto.

The data correction unit 33 corrects digital image data to be input to the corresponding pixel PXL based on the offset and the gain read from the compensation memory 32 in step S4. To this end, the data correction unit 33 may include a multiplier 33A and an adder 33B as shown in FIG. 2. The multiplier 33A multiplies the digital image data by the gain and supplies an output result to the adder 33B. The adder 33B adds the offset to the output result of the multiplier 33A and outputs a result as corrected digital image data V-DATA.

The host system 40 may supply digital image data to be input to the pixels PXL of the display panel 10 to the compensation IC 30. The host system 40 may further supply user input information, for example, digital brightness information to the compensation IC 30. The host system 40 may be implemented as an application processor.

FIGS. 6 to 8 illustrate various examples of a compensation module.

Referring to FIG. 6, the electroluminescent display according to the aspect of the disclosure may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement a compensation module.

The driver IC (D-IC) 20 may further include a compensator 34 and a compensation memory 32 in addition to a timing controller 21 and a data driver 22. In FIG. 6, the compensator 34 includes a parameter calculation unit 31 and a data correction unit 33. The compensation module is implemented by combining the driver IC (D-IC) 20 and a compensation IC 30 (see FIG. 1) into one chip. The power IC (P-IC) 60 generates various driving powers required to operate the compensation module.

Referring to FIG. 7, the electroluminescent display according to the aspect of the disclosure may include a driver IC (or referred to as "D-IC") 20 mounted on a chip-on film (COF), a storage memory 50 and a power IC (or referred to as "P-IC") 60 mounted on a flexible printed circuit board (FPCB), and a host system 40 mounted on a system printed circuit board (SPCB), in order to implement an compensation module.

The compensation module of FIG. 7 is different from the compensation module of FIG. 6 in that a compensator 34 and a compensation memory 32 are mounted on the host system 40 without being mounted on the driver IC 20. The compensation module of FIG. 7 is implemented by integrating a compensation IC 30 (shown in FIG. 1) into the host system 40 and is meaningful in that the configuration of the driver IC 20 can be simplified.

Referring to FIG. 8, the electroluminescent display according to the aspect of the disclosure may include a driver IC (or referred to as "D-IC") 20 mounted on a chip-on film (COF), a storage memory 50, a compensation IC 30, a compensation memory 32, and a power IC (or referred to as "P-IC") 60 mounted on a flexible printed circuit board (FPCB), and a host system 40 mounted on a system printed circuit board (SPCB), in order to implement a compensation module.

The compensation module of FIG. 8 is different from the compensation modules of FIGS. 6 and 7 in that the configuration of the driver IC 20 is further simplified by mounting only a data driver 22 in the driver IC 20, and a timing controller 21 and the compensation memory 32 are mounted in the compensation IC 30 that is separately manufactured. The compensation module of FIG. 8 can easily perform an uploading and downloading operation of a compensation value by together mounting the compensation IC 30, the storage memory 50, and the compensation memory 32 on the flexible printed circuit board. Further, the compensation module of FIG. 8 can simplify the configuration of the compensation IC 30 by separately disposing the compensation memory 32 from the compensation IC 30 on the flexible printed circuit board.

FIG. 9 illustrates configuration of a pixel according to an exemplary aspect of the disclosure.

Referring to FIG. 9, a pixel PXL according to an exemplary aspect may include an OLED, a driving TFT DT, a storage capacitor Cst, a first switching TFT ST1, and a second switching TFT ST2.

The OLED is a light emitting element that emits light with a driving current Ioled input from the driving TFT DT. The OLED includes an anode electrode, a cathode electrode, and an organic compound layer between the anode electrode and the cathode electrode. The anode electrode is connected to a second node N2 that is a source electrode of the driving TFT DT. The cathode electrode is connected to an input terminal of a low potential driving power EVSS. A gray level of an image displayed on a corresponding pixel PXL is determined depending on an amount of light emitted by the OLED.

The driving TFT DT is a driving element controlling the driving current Ioled input to the OLED depending on a gate-to-source voltage of the driving TFT DT. The driving TFT DT includes a gate electrode connected to a first node N1, a drain electrode connected to an input terminal of a high potential driving power EVDD, and a source electrode connected to the second node N2.

The storage capacitor Cst is connected between the first node N1 and the second node N2. The storage capacitor Cst holds the gate-to-source voltage of the driving TFT DT for a particular time.

The first switching TFT ST1 is turned on in response to the first gate signal SCAN1 and applies the data voltage charged to the data line 140 to the first node N1. The first switching TFT ST1 includes a gate electrode connected to the first gate line 150A, a drain electrode connected to the data line 140, and a source electrode connected to the first node N1.

The second switching TFT ST2 is turned on in response to the second gate signal SCAN2 and applies the reference voltage Vref charged to the reference line 160 to the second node N2. The second switching TFT ST2 includes a gate electrode connected to the second gate line 150B, a drain electrode connected to the reference line 160, and a source electrode connected to the second node N2.

FIG. 10 is a timing diagram illustrating compensation for a change in mobility of a driving TFT of a pixel shown in FIG. 9.

Referring to FIG. 10, a display mode, in which a change in mobility of a driving TFT is automatically compensated, includes an initialization period Ti, a programming period Tw, a compensation period Tc, and an emission period Te to form one frame.

The gate driver 15 generates a first gate signal SCAN1 and supplies the first gate signal SCAN1 to the first gate line 150A. Further, the gate driver 15 generates a second gate signal SCAN2 and supplies the second gate signal SCAN2 to the second gate line 150B.

The first gate signal SCAN1 is input at an OFF-level in the initialization period Ti before the compensation period Tc, at an ON-level from the programming period Tw between the initialization period Ti and the compensation period Tc to the compensation period Tc, and at an OFF-level in the emission period Te following the compensation period Tc. The second gate signal SCAN2 is input at an ON-level from the initialization period Ti to the programming period Tw and at an OFF-level from the compensation period Tc to the emission period Te.

The data driver 22 supplies the reference voltage Vref to the reference line 160 in the initialization period Ti and the programming period Tw and supplies the data voltage Vdata to the data line 140 in the programming period Tw and the compensation period Tc.

The reference voltage Vref is applied to the second node N2 through the second switching TFT ST2 during the initialization period Ti and the programming period Tw. The data voltage Vdata is applied to the first node N1 through the first switching TFT ST1 during the programming period Tw and the compensation period Tc.

A detailed operation of the pixel PXL in the display mode is described with reference to FIGS. 9 and 10.

During the initialization period Ti, the first switching TFT ST1 is turned off, and the second switching TFT ST2 is turned on. As a result, the second node N2 and the anode electrode of the OLED are initialized to the reference voltage Vref in the initialization period Ti.

During the programming period Tw, both the first and second switching TFTs ST1 and ST2 are turned on. As a result, in the programming period Tw, the data voltage Vdata is applied to the first node N1, and the reference voltage Vref is applied to the second node N2. In the programming period Tw, a gate-to-source voltage Vgs of the driving TFT DT is programmed to 'Vdata-Vref'. Because 'Vdata-Vref' is set to be greater than a threshold voltage of the driving TFT DT, the driving TFT DT is programmed to turn-on conditions.

During the compensation period Tc, the first switching TFT ST1 is turned on, and the second switching TFT ST2 is turned off. As a result, in the compensation period Tc, a potential VN1 of the first node N1 is fixed to the data voltage Vdata, and a potential VN2 of the second node N2 rises due to a drain-to-source current Ids flowing in the driving TFT DT. The potential VN2 of the second node N2 rises at different slopes depending on the mobility of the driving TFT DT. More specifically, the potential VN2 of the second node N2 rises in proportion to the mobility of the driving TFT DT.

A magnitude of the drain-to-source current Ids of the driving TFT DT is proportional to the mobility of the driving TFT DT. Therefore, as the mobility of the driving TFT DT relatively increases, the potential VN2 of the second node N2 relatively increases as indicated by the thick dotted line of FIG. 10. In FIG. 10, solid line, thick dotted line, and thin dotted line are shown to indicate a change in the potential VN2 of the second node N2. In FIG. 10, the solid line is used when a change in the mobility of the driving TFT DT is $\Delta\alpha$; the thick dotted line is used when the change in the mobility of the driving TFT DT is $\Delta\alpha+10\%$; and a thin dotted line is used when the change in the mobility of the driving TFT DT is $\Delta\alpha-10\%$.

Because the gate-to-source voltage Vgs of the driving TFT DT via the compensation period Tc is determined to be inversely proportional to the mobility of the driving TFT DT, a current variation resulting from the change in the mobility of the driving TFT DT is automatically compensated. Namely, the gate-to-source voltage Vgs of the driving TFT DT when the mobility of the driving TFT DT is $\Delta\alpha+10\%$ is set to be less than that when the mobility of the driving TFT DT is $\Delta\alpha$. Therefore, a magnitude of the current Ids generated in the driving TFT DT at the mobility of $\Delta\alpha+10\%$ is compensated at a level similar to a magnitude of the current Ids generated in the driving TFT DT at the mobility of $\Delta\alpha$. Further, the gate-to-source voltage Vgs of the driving TFT DT when the mobility of the driving TFT DT is $\Delta\alpha-10\%$ is set to be greater than that when the mobility of the driving TFT DT is $\Delta\alpha$. Therefore, a magnitude of the current Ids generated in the driving TFT DT at the mobility of $\Delta\alpha-10\%$ is compensated at a level similar to a magnitude of the current Ids generated in the driving TFT DT at the mobility of $\Delta\alpha$.

During the emission period Te, both the first and second switching TFTs ST1 and ST2 are turned off. As a result, the gate-to-source voltage Vgs of the driving TFT DT determined in the compensation period Tc is held during the emission period Te, and the current Ids, in which the change in the mobility of the driving TFT DT is compensated, flows in the driving TFT DT. In the emission period Te, the current Ids generated in the driving TFT DT is applied to the OLED. The OLED emits light with brightness corresponding to a driving current Ioled and represents a gray level of an image.

FIG. 11 illustrates another configuration of a pixel according to an exemplary aspect of the disclosure.

Referring to FIG. 11, a pixel PXL according to an exemplary aspect may include an OLED, a driving TFT DT, a storage capacitor Cst, a first switching TFT ST1, and a second switching TFT ST2.

Configuration of the pixel PXL of FIG. 11 is substantially the same as configuration of the pixel PXL of FIG. 9, except for a connection configuration of the second switching TFT ST2. In the pixel PXL of FIG. 11, one electrode of the second switching TFT ST2 is not connected to a reference line and is connected to a ground power supply GND. When the one electrode of the second switching TFT ST2 is connected to the ground power supply GND as described above, a number of reference lines of the display panel can decrease. Hence, an aperture ratio can increase. Further, because the data driver 22 does not need to generate a reference voltage, a driving load of the data driver 22 can decrease.

In the pixel PXL of FIG. 11, the second switching TFT ST2 is turned on in response to the second gate signal SCAN2 and thus applies the ground power supply GND to a second node N2. The second switching TFT ST2 includes a gate electrode connected to the second gate line 150B, a drain electrode connected to the ground power supply GND, and a source electrode connected to the second node N2.

A detailed operation of the pixel PXL of FIG. 11 in the display mode is substantially the same as that illustrated in FIG. 10, except that the ground power supply GND is applied instead of the reference voltage.

As described above, aspects of the present disclosure previously store the result of camera-based sensing in a memory and use the sensing result for the initial compensation, thereby reducing the sensing time required for the initial compensation. In addition, because aspects of the present disclosure do not require the sensing circuit, aspects of the present disclosure can reduce the chip size and the manufacturing cost of the driver IC by removing the sensing circuit from the driver IC. Because aspects of the present disclosure do not require a sensing drive, aspects of the present disclosure can simplify the circuit configuration of the gate driver.

Furthermore, because aspects of the present disclosure can compensate for the change in the mobility of the driving TFT in real time in the compensation period of the display mode, aspects of the present disclosure can prevent the accuracy of the compensation from being reduced due to a local temperature influence.

Although various aspects have been described with reference to a number of illustrative aspects thereof, numerous other modifications and aspects may be devised by those skilled in the art that will fall within the scope of the principles of this disclosure. In particular, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electroluminescent display device comprising:

a storage memory storing an average current-voltage expression of a display panel and a current value for each pixel;

a parameter calculation unit calculating an offset and a gain for each pixel for causing current characteristics for each pixel based on the current value for each pixel to coincide with average current characteristics based on the average current-voltage expression; and a data correction unit correcting input image data to be written to each pixel based on the offset and the gain for each pixel, wherein the average current-voltage expression and the current value for each pixel are obtained through a camera-based sensing process, and represents initial characteristic values before a driving thin film transistor (TFT) of each pixel is deteriorated, wherein the parameter calculation unit readouts an equation of $I=a(Vdata-b^{c})$ corresponding to the average current-voltage expression of a plurality of gray levels from the storage memory, where "a" is an electron mobility of a driving TFT, "b" is a threshold voltage of the driving TFT, and "c" is a physical property value of the driving TFT, and wherein the parameter calculation unit calculates parameter values (a' and b') for the average current-voltage expression of a corresponding pixel based on two current values (I1 and I2) and two gray values (Vdata1 and Vdata2) measured by the camera-based sensing process at two gray points, where $I1=a'(Vdata1-b'^{c})$ and $I2=a'(Vdata2-b')^{c}$.

2. The electroluminescent display device of claim 1, wherein the average current-voltage expression is obtained by applying a least square method to a result of the camera-based sensing process for each pixel at each of a plurality of gray levels.

3. The electroluminescent display device of claim 1, wherein the storage memory stores the current value for each pixel with respect to at least two gray points.

4. The electroluminescent display device of claim 3, wherein the parameter calculation unit calculates a parameter necessary for a current-voltage expression for each pixel based on a current value and a gray value measured at the at least two gray points and calculates the offset and the gain for each pixel for causing the current-voltage expression for each pixel to coincide with the average current-voltage expression.

5. The electroluminescent display device of claim 1, wherein the data correction unit multiplies the input image data by the gain and adds the offset to the input image data.

6. The electroluminescent display device of claim 1, wherein the average current-voltage expression and the current value for each pixel represents initial characteristic values before a driving thin film transistor (TFT) of each pixel is deteriorated.

7. The electroluminescent display device of claim 1, wherein each pixel comprises:

a driving thin film transistor (TFT) including a gate electrode connected to a first node, a drain electrode connected to an input terminal of a high potential driving power, and a source electrode connected to a second node;

a first switching TFT connected to the first node and a data line supplied with a data voltage based on the input image data and switched on and off in response to a first gate signal;

a second switching TFT connected to the second node and one of a reference line supplied with a reference voltage or a ground power supply, and switched on and off in response to a second gate signal;

a storage capacitor connected to the first node and the second node; and an organic light emitting diode connected to the second node and an input terminal of a low potential driving power.

8. The electroluminescent display device of claim 7, wherein the first node has a potential set to be the same as the data voltage and the second node has a potential to rise in proportion to a mobility of the driving TFT during a compensation period in which the mobility of the driving TFT is compensated.

9. The electroluminescent display device of claim 8, further comprising a gate driver configured to generate the first gate signal and the second gate signal, wherein the first gate signal is input at an OFF-level during an initialization period before the compensation period, at an ON-level from a programming period between the initialization period and the compensation period to the compensation period, and at an OFF-level in an emission period following the compensation period, and wherein the second gate signal is input at an ON-level from the initialization period to the programming period and at an OFF-level from the compensation period to the emission period.

10. The electroluminescent display device of claim 9, further comprising a data driver configured to supply the reference voltage to the reference line during the initialization period and the programming period and supply the data voltage to the data line during the programming period and the compensation period.

11. The electroluminescent display device of claim 10, wherein the reference voltage is applied to the second node through the second switching TFT during the initialization period and the programming period, and wherein the data voltage is applied to the first node through the first switching TFT during the programming period and the compensation period.

12. A method of compensating for electrical characteristics of an electroluminescent display device, comprising:

storing an average current-voltage expression of a display panel and a current value for each pixel in a storage memory;

calculating an offset and a gain for each pixel for causing current characteristics for each pixel based on the current value for each pixel to coincide with average current characteristics based on the average current-voltage expression; and correcting input image data to be written to each pixel based on the offset and the gain for each pixel, wherein the average current-voltage expression and the current value for each pixel are obtained through a camera-based sensing process, and represents initial characteristic values before a driving thin film transistor (TFT) of each pixel is deteriorated, wherein the parameter calculation unit readouts an equation of $I=a(Vdata-b^{c})$ corresponding to the average current-voltage expression of a plurality of gray levels from the storage memory, where "a" is an electron mobility of a driving TFT, "b" is a threshold voltage of the driving TFT, and "c" is a physical property value of the driving TFT, and wherein the parameter calculation unit calculates parameter values (a' and b') for the average current-voltage expression of a corresponding pixel based on two current values (I1 and I2) and two gray values (Vdata1 and Vdata2) measured by the camera-based sensing process at two gray points, where $I1=a'(Vdata1-b'^{c})$ and $I2=a'(Vdata2-b'^{c})$.

13. The method of claim 12, wherein the average current-voltage expression is obtained by applying a least square method to a result of the camera-based sensing process for each pixel at each of a plurality of gray levels.

14. The method of claim 12, wherein the storage memory stores the current value for each pixel with respect to at least two gray points.

15. The method of claim 14, wherein the calculating of the offset and the gain for each pixel comprises:

calculating a parameter necessary for a current-voltage expression for each pixel based on a current value and a gray value measured at the at least two gray points; and calculating the offset and the gain for each pixel for causing the current-voltage expression for each pixel to coincide with the average current-voltage expression.

16. The method of claim 12, wherein the correcting of the input image data to be written to each pixel based on the offset and the gain for each pixel includes multiplying the input image data by the gain and adding the offset to the input image data.

17. The method of claim 12, wherein the average current-voltage expression and the current value for each pixel represents initial characteristic values before a driving thin film transistor (TFT) of each pixel is deteriorated.

18. The method of claim 17, wherein a mobility of the deteriorated driving TFT is compensated during a compensation period, wherein a potential of a first node connected to a gate electrode of the driving TFT is set to be the same as a data voltage based on the input image data during the compensation period, and a potential of a second node connected to a source electrode of the driving TFT varies depending on the mobility of the driving TFT during the compensation period.

19. The method of claim 18, wherein the potential of the second node rises in proportion to the mobility of the driving TFT during the compensation period.

* * * * *